US012780367B2

(12) United States Patent
Batten

(10) Patent No.: US 12,780,367 B2
(45) Date of Patent: Nov. 3, 2026

(54) METHOD AND DEVICE OF BALANCING A MARINE VESSEL

(71) Applicant: Keith Batten, Advance, NC (US)

(72) Inventor: Keith Batten, Advance, NC (US)

( * ) Notice: Subject to any disclaimer, the term of this patent is extended or adjusted under 35 U.S.C. 154(b) by 291 days.

(21) Appl. No.: 18/623,162

(22) Filed: Apr. 1, 2024

(65) Prior Publication Data

US 2024/0351668 A1 Oct. 24, 2024

Related U.S. Application Data

(63) Continuation-in-part of application No. 18/302,877, filed on Apr. 19, 2023, now Pat. No. 12,510,432.

(51) Int. Cl.
*B63B 39/02* (2006.01)

(52) U.S. Cl.
CPC ..... *B63B 39/02* (2013.01)

(58) Field of Classification Search
CPC ..... B63B 39/02; B63C 5/02; B63C 1/10
See application file for complete search history.

(56) References Cited

U.S. PATENT DOCUMENTS 3,635,492 A * 1/1972 Mauldin ..... B62D 53/062 280/43.23
5,634,761 A * 6/1997 Carrick ..... B60P 3/1066 414/529
9,862,297 B2 * 1/2018 Dagenais ..... B60P 1/433
11,738,836 B1 * 8/2023 Dildy ..... B63C 5/02 114/44

* cited by examiner

*Primary Examiner* — Sheetal R Paulson
(74) *Attorney, Agent, or Firm* — Russell D. Nugent; Comprising IP

(57) ABSTRACT

A method and device for finding the center of balance with respect to the longitudinal axis of a marine vessel or other large vessel that includes a carriage pivotably attached to a subframe via one or more pivot pins inserted into pillow block bearings. Boat bunks are attached to horizontal rails of the carriage such that they can slide independently along those rails. The carriage can feature a number of stoppers that are positioned to engage with a portion of the subframe when the carriage tips far enough to the right or left side. These stopers can activate scales located on the subframe to assist the user in centering or balancing the mass of the vessel and any equipment located therein.

11 Claims, 4 Drawing Sheets

METHOD AND DEVICE OF BALANCING A MARINE VESSEL

CROSS-REFERENCE TO RELATED APPLICATIONS

This application claims the benefit of priority to U.S. Non-Provisional application Ser. No. 18/302,877 filed on Apr. 19, 2023. The content of U.S. Non-Provisional application Ser. No. 18/302,877 filed on Apr. 19, 2023 is incorporated by reference in its entirety.

BACKGROUND OF THE INVENTION

(a) Field of the Invention

The present invention is in the technical field of marine equipment and accessories. More particularly, the present disclosure relates to a method and a device that allows someone to balance a marine vessel (or other object) along its longitudinal axis.

(b) Background Art

Boat storage is a problem common to boat owners across the United States. Most boat owners do not live on the water or have a private water access. As a result, a very large percentage of the boats owned by Americans are stored on dry land. This of course necessitates the boat be transported to water for the boat owner to enjoy their boat. Transportation entails its own problems.

In order to safely transport a marine vessel on a trailer, the vessel has to be properly positioned on that trailer. If the vessel is not properly positioned on the trailer, then there's a very high chance that a portion of boat will either not be supported correctly or be carrying more than its fair share of the weight. If the boat is not positioned properly, it can rock back-and-forth during transport causing damage to the boat. In addition, if the vessel is not properly positioned then the vessel may move on the trailer during transport. This can cause damage to the boat as well as a motor vehicle accident.

As a result, boat owners have a need to locate the center of gravity of their marine vessels prior to trying to load them onto a trailer. A marine vessel can be balanced in three different directions—along the longitudinal, transverse and vertical axes. The vertical or yaw axis is an imaginary line running vertically through the ship and through its center of mass. A transverse axis or pitch axis is an imaginary line running horizontally across the ship and through the center of mass. Pitch refers to the up and down motion of the bow and stern. Finally, the longitudinal axis or roll axis is an imaginary line running horizontally through the length of the ship, through its center of mass, and parallel to the waterline.

Previously, the inventor developed a device and method for balancing a marine vessel along the transverse axis, i.e. centering the boat such that the bow and stern of the boat are positioned so that the boat does not pitch or move up and down along an imaginary line running through the center of the boat. Doing so allows the user to position the boat on a trailer such that the bow and stern will not move up and down while the boat is being transported. Failing to properly boat on a trailer can lead the boat to move during transport causing a number of difficulties. If the boat is not positioned properly, it can rock back-and-forth during transport causing damage to the boat. In addition, if the vessel is not properly positioned then the vessel may move on the trailer during transport. This can cause damage to the boat as well as a motor vehicle accident. Moreover, if a portion of the hull of the boat is carrying more weight than it should, then the whole of the boat can wind up becoming dented or abraded.

A related problem occurs when the user tries to load their boat onto a trailer in that the boat needs to be balanced along the longitudinal axis of the boat. A lot of boat owners assume that the keel represents the center of gravity with respect to side-to-side motion (pitch) of the boat during transport. However, boat owners face a lot of difficulty simply centering a boat on a trailer, even with this assumption in mind. Frequently they use guideposts or "guide-ons" attached to their trailer when they are taking the boat out of the water so that they can visually center the boat while loading it onto a trailer. However, because boats have consoles, steering wheels, covers, shades, and a plethora of different types of equipment loaded onto them, preventing the boat from rolling side to side while on a trailer may involve placing the keel off the boat "off-center." As a result, there is need in the industry for a device that allows a boat user to calculate accurately where the center of gravity is with respect to the longitudinal axis of the vessel so that they can load their vessel onto a trailer properly and safely.

A goal of the present disclosure is to provide such a method and device that allows a user, especially an inexperienced boat owner, an easy, convenient and more straightforward means of accurately calculating the exact center of gravity of the boat with respect to the longitudinal axis accurately.

BRIEF SUMMARY OF THE INVENTION

The present invention is a device and method of using same the allows a person to easily and accurately balance a marine vessel along its longitudinal axis. The device includes a carriage capable of holding the weight of a marine vessel. Preferred embodiments and the inventors anticipated best mode of the device include a carriage that has two or more boat bunks which are elongated structures arranged side by side or parallel to each other onto which a boat or other marine vessel can be placed. The boat bunks extend at least part of the way from between the back of the carriage and the front of the carriage. The carriage also features a plurality of rails that extend horizontally from the right side of the carriage to the left side of the carriage. Preferred embodiments of the device include boat bunks that are adjustable, i.e. they can be manipulated to move toward and way from each other by sliding along one or more rails. This arrangement allows the user to adjust the width of the carriage such that it can accommodate different widths of marine vessels.

The carriage is supported by a subframe. The subframe has an approximate center or central portion that is raised with respect to the sides of the subframe. This central portion features a pivot pin or a structure upon which the carriage is positioned and supported that allows the carriage to tip back and forth or side to side with respect to the longitudinal axis of the device. Features in this disclosure means has, attached to, integrated into, on top of, inside, positioned proximate to or included within. When the vessel is balanced, the vessel rests on the pivot pin and the carriage is level, i.e. neither side of the carriage tilts downward. When the carriage is evenly balanced on each side, the boat bunks/carriage are level with the ground. When a vessel or any other object is placed in the carriage, the weight of that object will cause the carriage to rock from side to side if the vessel is not properly centered over the pivot pin. The vessel will then come to rest with one side of the carriage lower than the other side of the carriage indicating the boat is not centered properly on the carriage. The user can adjust the position of the vessel or boat on the carriage until it is evenly balanced on either side and the carriage is level. Some embodiments of the carriage include one or more levels, i.e. sealed transparent tubes oriented horizontally or vertically on the carriage to assist the under in figuring out what the carriage is completely level.

Still other embodiments and the inventor's anticipated best mode of the device include one or more scales featured by the device. Preferred embodiments include at least one scale on either side of the carriage. Each scale is positioned such that it will contact a location on the subframe when the side of the carriage featuring that scale carries enough weight to make that end move downward. The scale contacts this portion of the subframe causing pressure to be applied to the scale. The scale can thus be used to calculate how much weight is being applied to the subframe by either side of the carriage. The scales can be connected to an electronic readout that is visible on the outside of the carriage for ease of use. If the vessel is not centered over the pivot pins, then one side of the boat will tip downward applying weight/pressure to one of the scales. In this manner, the user can balance their boat such that the weight of the vessel is distributed to their liking.

DETAILED DESCRIPTION OF THE INVENTION

Figure 1:
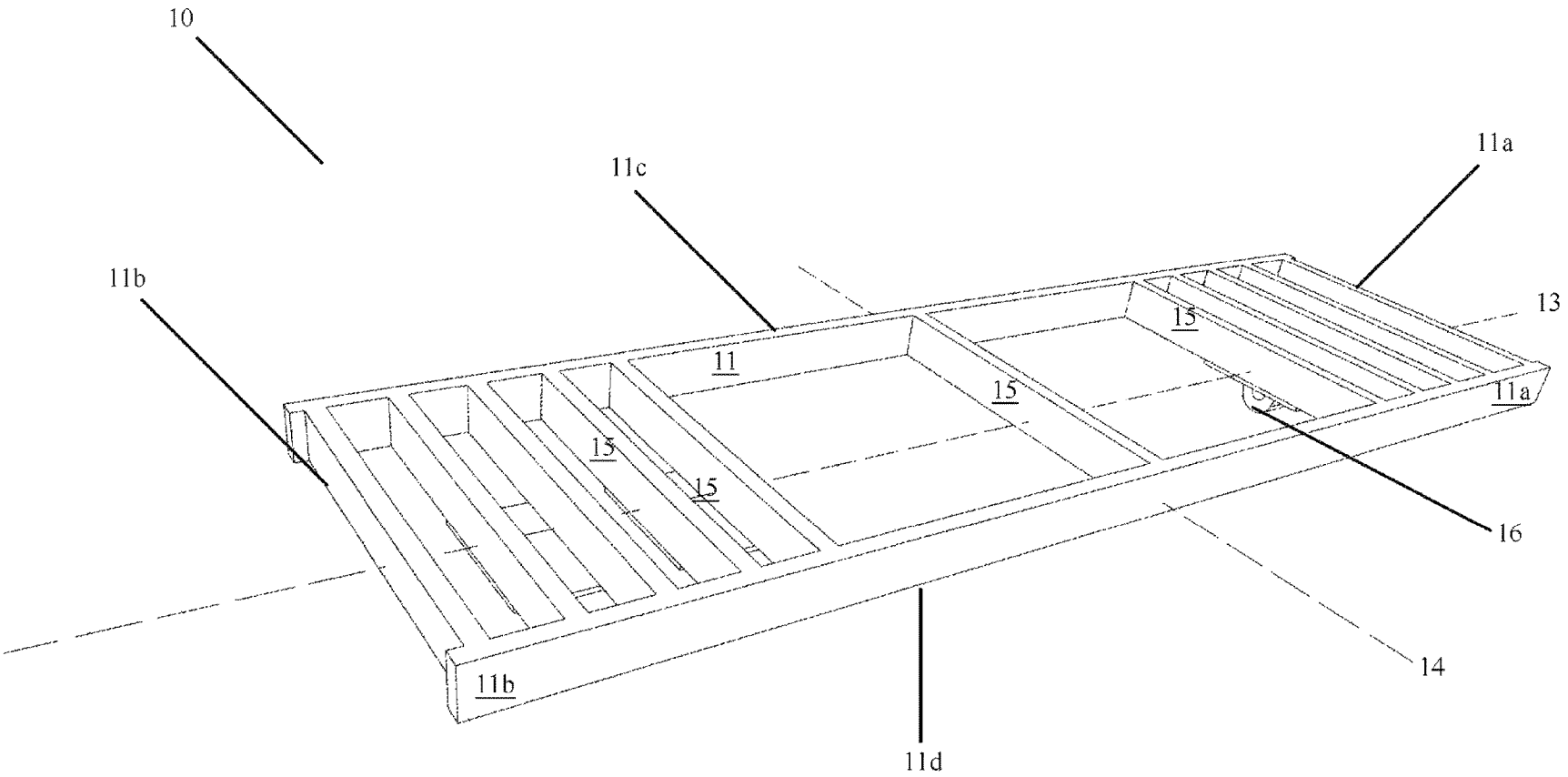
FIG. 1 is a top perspective view of a first embodiment of the carriage.

Hereinafter, for convenience of description, the terms "left", "right", "up" and "down" will be used in accordance with the left, right, up and down directions of the drawings themselves. The terms "first", "second", and the like, hereinafter, are used for descriptive purposes only and have no other special meanings. Identical or equivalent parts are denoted by the same reference numerals in the various figures and usually described only once.

Figure 2:
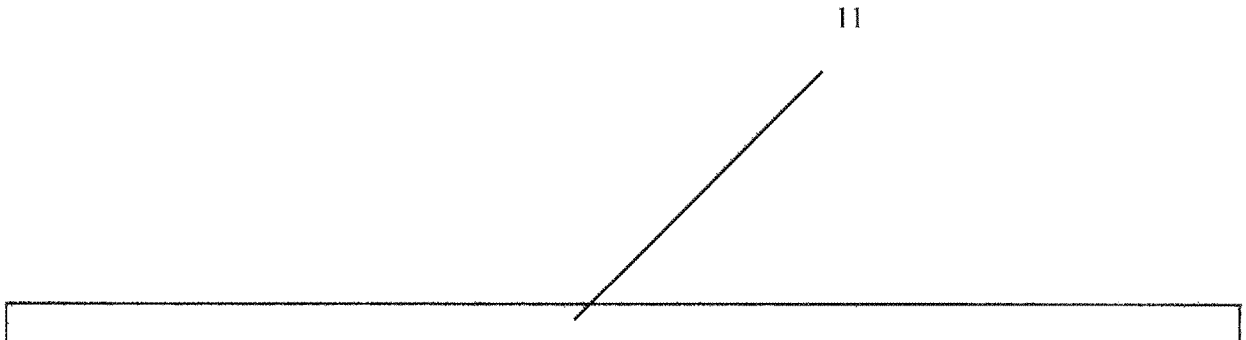
FIG. 2 is a side plan view thereof.
Figure 3:
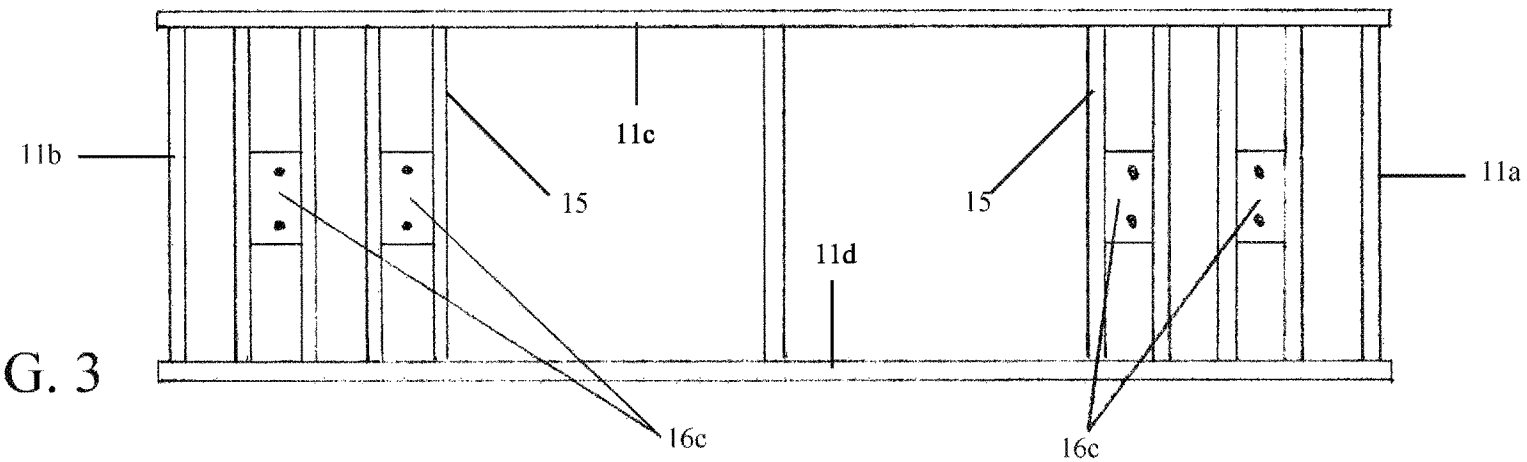
FIG. 3 is a top plan view thereof.
Figure 4:
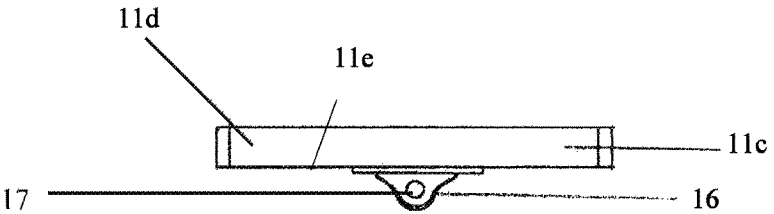
FIG. 4 is a front plan view thereof.

FIG. 1 shows the carriage 11 of the device 10 with the boat bunks removed. FIG. 1 also has labeled both the longitudinal 13 and the transverse axes 14 of the carriage 11. FIGS. 2-4 are plan views of the same carriage 11 from the side, top and end. The carriage 11 includes a plurality of rails 15 that extend horizontally from a left side 11*c* of the carriage 11 to the right side 11*d* of the carriage 11. The number and positioning of the rails 15 can be modified without effecting the manner in which the device works, but preferred embodiments and the inventor's anticipated best mode include between 2 and 5 such horizontal rails 15 on a front half of the carriage 11 and the same number on the opposing back half of the carriage 11.

The carriage 11 incudes at least one pillar block bearing a/k/a a pillow block bearing 16 that is mounted to a bottom surface 11*e* of the carriage 11. The version shown in FIG. 3 has two such pillar block bearings 16 on each of a front end 11*a* and a back end 11*b* of the carriage 11. A pillar block bearing 16 is a mounting block or pedestal 16*b* that is secured to the to another structure, in this case the carriage 11, and contains an opening and a bearing 16*a* surrounding said opening resulting in a support for a cylindrical shaft, i.e. the pivot pin 17. The bearing 16*a* housed in the mounting block 16*b* allows for the carriage 11 to rock back and forth or roll with respect to the longitudinal axis 13 once the pivot pin 17 (described below) is inserted into the opening in the block or pedestal 16*b* therein. As seen in FIGS. 2 and 3, the carriage 11 can include multiple attachment points 16*c* for the pillow block bearings 16.

Figure 5:
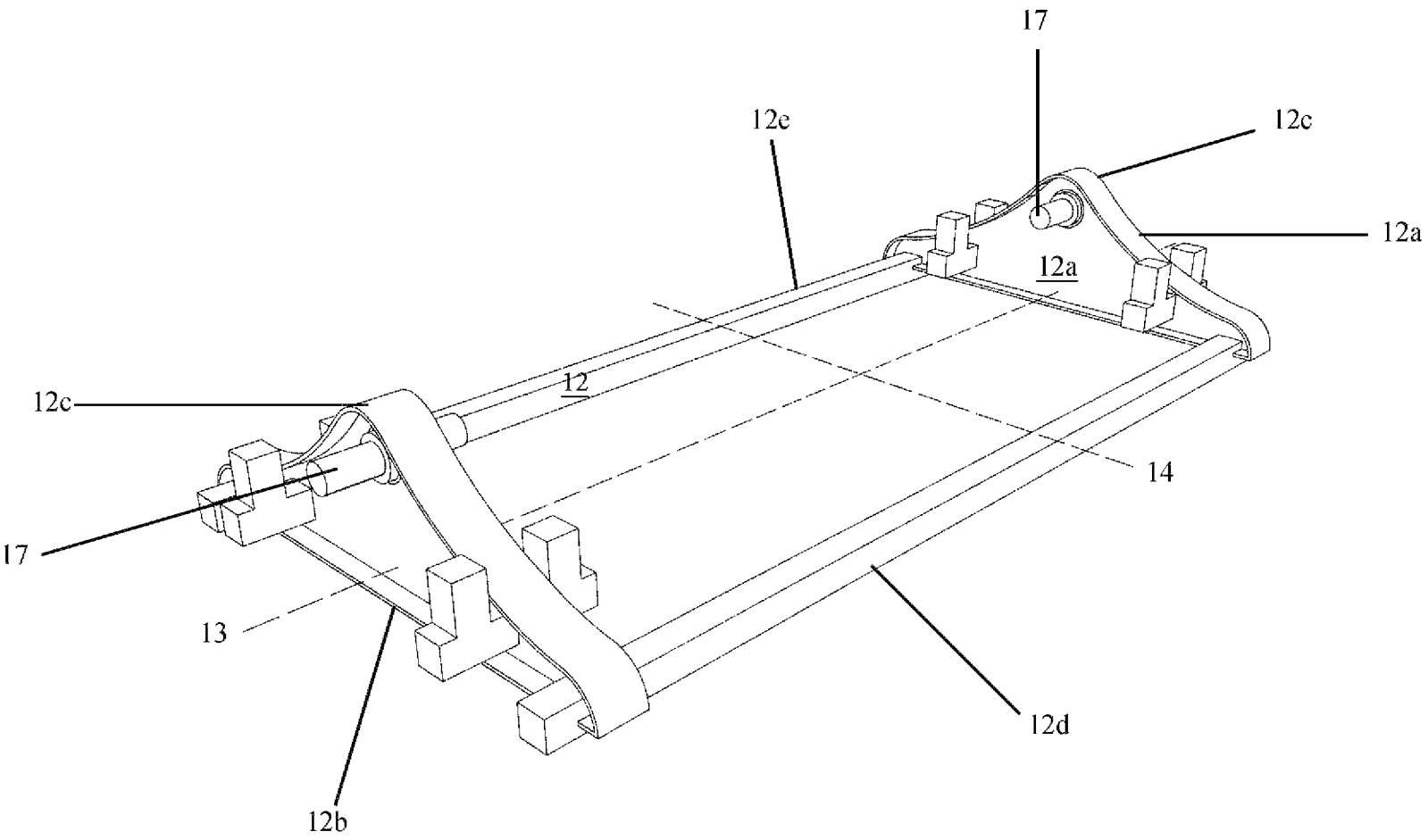
FIG. 5 is a front perspective view of a first embodiment of the subframe.

FIG. 5 shows the subframe 12 that supports the carriage 11. The subframe 12 of the device has a front end 12*a* and a back end 12*b* each of which include a raised central portion 12*c* that slopes downward to a right side 12*d* and a left side 12*e* of the subframe 12. The central raised portion 12*c* of the subframe 12 includes at least two structures that act as pivot pins 17 on which the carriage 11 is placed. These pivot pins 17 are cylindrical shafts that are inserted through openings 19 in the subframe 12 and/or are attached to or integrated into the subframe 12 near the apex of the central raised portion 12*c* at each end of the subframe 12. The pivot pins 17 could be one continuous structure, but in preferred embodiments, each end 12*a*, 12*b* of the subframe 12 includes a single such pivot pin 17 inserted through the subframe 12 such that a portion of each pivot pin 17 extends away from the central raised portion 12*c* of the subframe 12 in both directions. The pivot pins 17 are secured into or onto both the front end 12*a* and the back end 12*b* of the subframe 12 such that they do not turn or pivot. The pivot pins 17 are positioned to align with a longitudinal axis 13 of the subframe 12 which also aligns with the longitudinal axis 13 of the carriage 11.

Figure 6:
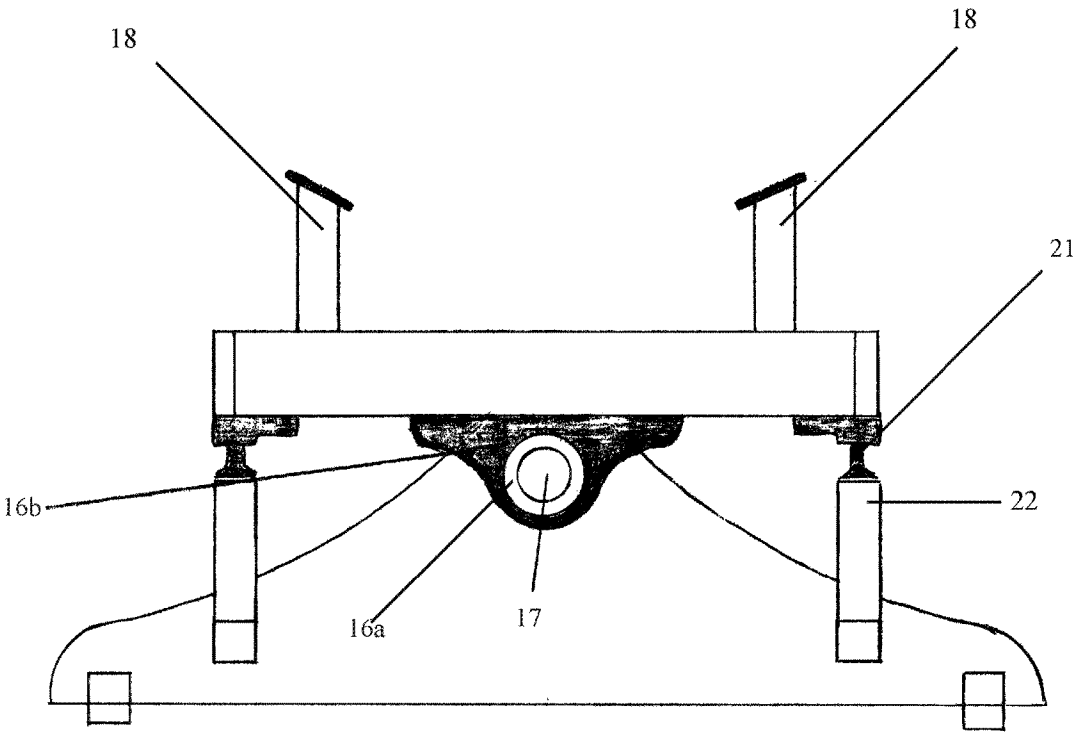
FIG. 6 is a front plan view of the device fully assembled.
Figure 7:
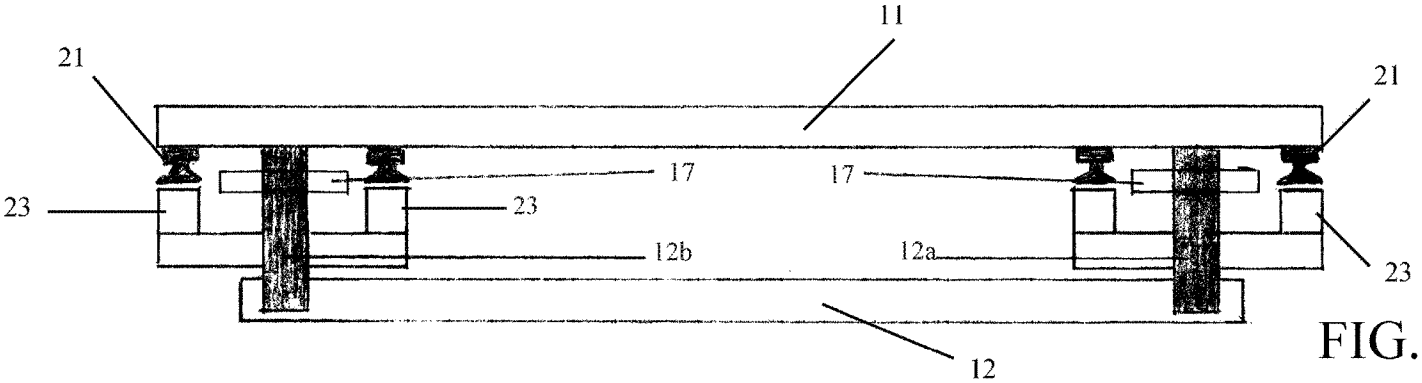
FIG. 7 is a side plan view thereof.

FIGS. 6 and 7 show the device fully assembled, i.e. with the carriage 11 engaged with the pivot pins 17 on the subframe 12. FIG. 6 in particular shows the boat bunks 18 that are slidably attached to the carriage 11. In this embodiment, the right side 11*d* and the left side 11*c* of the carriage 11 include contact points or stoppers 21 that contact the subframe 12 when the carriage 11 tilts far enough to the right side 11*d* of the carriage 11 or the left side 11*c* of same. These stoppers 21 can either arrest the movement of the carriage 11 to one side and/or they can serve as contact points 22 for a scale or scales 23 that are present on the subframe 12.

FIGS. 6 and 7 also show a plurality of contact points 22 on the subframe 12 as well. In preferred embodiments, there are two contact 22 points on each of the right side 12*d* and the left side 12*e* of the subframe 12 at both the front end 12*a* and the back end 12*b* of the subframe 12. These contact points 22 serve to prevent the carriage 11 from tilting too far to the right side 11*d* or to the left side 11*c* when a vessel is placed on the device 10. In addition, some embodiments of the subframe 12 include scales 23 positioned on or adjacent to the contact points 22 such that the stoppers 21 on the carriage 11 apply pressure to one or more of those scales 23 when the carriage leans to one side. This allows the user to calculate how far "off center" the vessel is on the carriage so they can use that information to center the vessel properly. In other words, if the boat tips downward toward the left side 11*c* of the carriage 11 when the vessel is placed on the device 10, the user can take that weight measurement as a guide to how to adjust the positioning of the vessel or the equipment inside the vessel while it is still on the device 10.

The method of using the device is relatively straightforward. The user places a marine vessel or other object (not shown) onto the boat bunks 18 that are attached to the carriage 11. The user then allows the carriage 11 to come to rest on the fulcrum. To find the center of gravity of the vessel (not shown) the user moves the vessel side to side, toward or away from the right side 11*d* and the left side 11*c* of the carriage 11 until the carriage 11 is level when it comes to rest. The user has at that point has found the center of gravity of the vessel with respect to its longitudinal axis and can mark or measure its location for future reference. The scales 23 are operably connected to readouts on the subframe 12 so the user can easily see how much weight is applied to the left side 11*c* or right side 11*d* of the carriage 11.

The various parts of the device can be constructed of any durable materials strong enough to support the weight of the carriage and a marine vessel. Preferred embodiments of the device are made out of steel with the subframe being made of modified I-beams. The boat bunks can be made of metal, wood, plastic or any combination thereof. The scales are commercially available and can feature a protrusion or extension that attaches to the frame of the scale and applies pressure to it when it is pressed.

The device can be transported to a convenient location, i.e. it can be brought to the vessel rather than having it bring the vessel to the device. Preferred embodiments of the device include one or more pneumatic motors or lifters (not shown) that can raise and lower the device. The device can also be placed on wheels to make it more easily moved.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above-described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention.

I claim:

1. A device for positioning a vessel on a trailer comprising:

a carriage supported by a subframe, said carriage pivotably attached to the subframe, said carriage comprising:

at least one horizontal rail extending from a right side of the carriage to a left side of the carriage; and at least one pair of boat bunks slidably attached to the at least one horizontal rail; wherein said subframe comprises:

a front end and a back end positioned at opposing ends of the subframe wherein the front end has a first central raised portion and the back end has a second central raised portion;

a first pivot pin attached to the first central raised portion; and a second pivot pin attached to the second central raised portion;

wherein the first and second pivot pins extend away from the front and back ends of the subframe respectively and along a longitudinal axis of the subframe.

2. The device of claim 1 further comprising:

at least one pair of pillow block bearings positioned on a lower surface of the carriage proximate to a front end and a back end of the carriage; wherein each of the first and second pivot pins are engaged with the at least one of the pair of pillow block bearings.

3. The device of claim 2 further comprising:

at least one first stopper positioned on a side of a lower surface of the carriage;

at least one second stopper positioned on an opposing side of the lower surface of the carriage;

wherein said at least one first stopper and the at least one second stopper are positioned to arrest the movement of the carriage.

4. The device of claim 3 further comprising a first scale on the at least one contact point located on a first side of the subframe and a second scale positioned at the at least one contact point located on a second side of the subframe located on either side of the subframe.

5. A device for positioning a vessel on a trailer comprising:

a subframe comprising:

a front end with a first central raised portion and an opposing back end with a second central raised portion;

a first cylindrical pivot pin extending away from the front end of the subframe towards the back end of the subframe;

a second cylindrical pivot pin extending away from the back end of the subframe towards the front end;

a carriage pivotably attached to the first and second pivot pins.

6. The device of claim 5 further comprising at least one pair of boat bunks slidably attached to the carriage.

7. The device of claim 6 further comprising a first pillar block bearing attached to a bottom surface of the carriage and a second pillar block bearing attached to a bottom surface of the carriage; where the first pillar block bearing is engaged with the first cylindrical pivot pin and the second pillar block bearing is attached to the second cylindrical pivot pin.

8. The device of claim 7 wherein the carriage further comprises:

a left side and a right side;

at least one stopper positioned on the bottom surface of the right side of the carriage and at least one second stopper positioned on the bottom surface of the left side of the carriage; wherein said at least one stopper is positioned on the bottom surface of the right side of the carriage to arrest the movement of the carriage to the right side by contacting the subframe and the at least one second stopper is positioned on the bottom surface of the left side of the carriage to arrest the movement of the carriage to the left side by contacting the subframe.

9. The device of claim 8 further comprising at least one first contact point located on the subframe under the at least one first stopper located on the bottom surface of the right side of the carriage and at least one second contact point located on the subframe under the at least one second stopper located on the bottom surface of the left side of the carriage.

10. The device of claim 9 further comprising a first scale located at the at least one first contact point of the subframe and a second scale located at the at least one second contact point on the subframe.

11. A device for positioning a vessel on a trailer comprising:

a subframe comprising:

a front end and a back end and a first raised central portion at the front end and a second central raised portion at the back end;

a first fulcrum located on the first raised central portion at the front end of the subframe and a second fulcrum located on the second central raised portion at the back end of the subframe; and a carriage comprising:

a right side and a left side;

an upper surface and a lower surface;

a plurality of horizontal rails extending from the right side to the left side;

a front end and a back end;

a contact point located on a lower surface of the cradle on both the left side and the right side at both the front end and the back end of the cradle;

a plurality of scales located on portions of the subframe that are positioned to be contacted by the contact points on the cradle when the cradle tilts to the left side or the right side.

* * * * *